US011100870B2

(12) United States Patent
Jung

(10) Patent No.: US 11,100,870 B2
(45) Date of Patent: Aug. 24, 2021

(54) DISPLAY DEVICE

(71) Applicant: LG Display Co., Ltd., Seoul (KR)

(72) Inventor: Jinhee Jung, Samcheok-si (KR)

(73) Assignee: LG DISPLAY CO., LTD., Seoul (KR)

( * ) Notice: Subject to any disclaimer, the term of this patent is extended or adjusted under 35 U.S.C. 154(b) by 50 days.

(21) Appl. No.: 16/669,432

(22) Filed: Oct. 30, 2019

(65) Prior Publication Data

US 2020/0143752 A1 May 7, 2020

(30) Foreign Application Priority Data

Nov. 2, 2018 (KR) ..... 10-2018-0133515

(51) Int. Cl.
*G09G 3/3291* (2016.01)

(52) U.S. Cl.
CPC ... *G09G 3/3291* (2013.01); *G09G 2310/0289* (2013.01)

(58) Field of Classification Search
CPC ..... G09G 3/3291; G09G 2310/0289
USPC ..... 345/204
See application file for complete search history.

(56) References Cited

U.S. PATENT DOCUMENTS

2004/0183792 A1* 9/2004 Takada ..... G09G 3/3648 345/204
2006/0176261 A1* 8/2006 Nitta ..... G09G 3/3406 345/94
2013/0201174 A1* 8/2013 Pyun ..... G09G 1/005 345/213

FOREIGN PATENT DOCUMENTS

KR 10-2013-0028353 A 3/2013
KR 10-2015-0079273 A 7/2015

* cited by examiner

*Primary Examiner* — Mark Edwards
(74) *Attorney, Agent, or Firm* — Seed IP Law Group LLP

(57) ABSTRACT

A display device may include: a display panel including a plurality of sub pixels; a data driving circuit configured to supply image data or fake data to a plurality of data lines; and a gate driving circuit configured to supply gate signals to a plurality of gate lines. The data driving circuit may supply the fake data to the plurality of data lines before the gate signal for an (n+1)th gate line is supplied after the gate signal for an n-th gate line is supplied, and a turn-on level period of the gate signal for the n-th gate line may include an overlap period that overlaps a turn-on level period of the gate signal for an (n−1)th gate line and a non-overlap period that does not overlap the turn-on level period of the gate signal for the (n−1)th gate line.

15 Claims, 9 Drawing Sheets

DISPLAY DEVICE

CROSS-REFERENCE TO RELATED APPLICATIONS

This application claims the priority of Korean Patent Application No. 10-2018-0133515, filed on Nov. 2, 2018, in the Korean Intellectual Property Office, the disclosure of which is hereby incorporated by reference in its entirety.

BACKGROUND

Technical Field

The present disclosure relates to a display device.

Description of the Related Art

With the development of information-oriented society, the demand for a display device for displaying an image has increased in various manners. Recently, a variety of display devices such as an LCD (Liquid Crystal Display), a PDP (Plasma Display Panel) and an OLED (Organic Light Emitting Diode) display device are utilized.

The LCD refers to a device which displays information using the property that the molecular arrangement of liquid crystal is varied when a voltage is applied to the liquid crystal, among various properties of the liquid crystal. The LCD includes two sheets of thin glass substrates and liquid crystal contained in a narrow gap between the glass substrates. The LCD applies a voltage to change the arrangement direction of the liquid crystal molecules, and transmits or reflects light to display information. Since the LCD can be made of a thinner plate than other display devices and has low power consumption, the LCD is widely used for a portable computer and the like.

The PDP includes gas tubes which are arranged between two pieces of glass plates to constitute a screen. Neon or argon is injected into the gas tubes. The PDP induces plasma by applying a voltage to electrodes connected to the gas tubes. The PDP converts ultraviolet rays generated through the plasma into visible rays by transmitting the ultraviolet rays through a fluorescent layer corresponding to three primary colors, and displays a color screen using the visible rays.

The OLED display device refers to a display device using an OLED which is a self-light emitting device that controls an organic light emitting layer to emit light through recombination of electrons and holes. Since the OLED display device has high luminance, should have a low driving voltage, and can be processed into an ultra-thin structure, the OLED display device is drawing attention as the next-generation display device.

While images are displayed through such display devices, various problems may occur. Representative examples of the problems may include motion blur indicating a phenomenon that the boundaries of moving objects are not clearly displayed but seem to be spread or the objects seem to be drawn, when a video is displayed through the display device. Furthermore, during a process of displaying an image, a specific area or line may become excessively bright depending on the states of charge of sub pixels or the positions of the sub pixels.

BRIEF SUMMARY

Various embodiments are directed to a display device capable of raising the quality of an image by improving the voltage charge ratios of sub pixels, when displaying the image.

Also, various embodiments are directed to a display device capable of reducing motion blur indicating a phenomenon that the boundaries of moving objects are not clearly displayed but seem to be spread or the objects seem to be drawn, when a video is displayed.

Also, various embodiments are directed to a display device capable of preventing a situation in which a specific line becomes excessively bright when an image is displayed.

Other advantages of the various embodiments of the present disclosure can be understood by the following description, and become apparent with reference to the embodiments of the present disclosure. Also, it is obvious to those skilled in the art to which the present disclosure pertains that the advantages of the various embodiments of the present disclosure can be realized by the means as claimed and combinations thereof.

In an embodiment, a display device may include: a display panel including a plurality of data lines, a plurality of gate lines, and a plurality of sub pixels defined by the plurality of data lines and the plurality of gate lines; a data driving circuit configured to supply image data or fake data to the plurality of data lines; and a gate driving circuit configured to supply gate signals to the plurality of gate lines.

The data driving circuit may supply the fake data to the plurality of data lines before the gate signal for an (n+1)th gate line is supplied after the gate signal for an n-th gate line is supplied, and a turn-on level period of the gate signal for the n-th gate line may include an overlap period that overlaps a turn-on level period of the gate signal for an (n−1)th gate line and a non-overlap period that does not overlap the turn-on level period of the gate signal for the (n−1)th gate line.

The gate driving circuit may retain the magnitude of the non-overlap period of the gate signal for the n-th gate line as a smaller magnitude than that of the overlap period of the gate signal for the n-th gate line.

The display device may further include a level shifter configured to supply the gate driving circuit with a plurality of clock signals for generating the gate signal, and the level shifter may modulate the pulse width of the clock signal corresponding to the gate signal for the n-th gate line, among the plurality of clock signals.

The level shifter may generate the plurality of clock signals based on a first reference signal and a second reference signal, and modulate the pulse width of the clock signal when the pulse width of the second reference signal is equal to or more than a predetermined reference pulse width.

The level shifter may generate the plurality of clock signals based on a first reference signal, a second reference signal and a clock select signal, and modulate the pulse width of the clock signal when the clock select signal is inputted.

In another embodiment, a display device may include: a display panel including a plurality of data lines, a plurality of gate lines, and a plurality of sub pixels defined by the plurality of data lines and the plurality of gate lines; a data driving circuit configured to supply image data or fake data to the plurality of data lines; a gate driving circuit configured to supply gate signals to the plurality of gate lines; a level shifter configured to supply the gate driving circuit with a plurality of clock signals for generating the gate signals; and a reference signal generation circuit configured to supply the level shifter with a first reference signal and a second reference signal for generating the plurality of clock signals.

A turn-on level period of the gate signal for an n-th gate line may include an overlap period that overlaps a turn-on level period of the gate signal for an (n−1)th gate line and a non-overlap period that does not overlap a turn-on level period of the gate signal for the (n−1)th gate line.

The level shifter may modulate the pulse width of the clock signal corresponding to the gate signal for the n-th gate line among the plurality of clock signals, such that the magnitude of the non-overlap period of the gate signal for the n-th gate line is retained as a smaller magnitude than that of the overlap period of the gate signal for the n-th gate line.

The reference signal generation circuit may adjust the pulse width of the second reference signal to less than a predetermined reference pulse width or equal to or more than the predetermined reference pulse width, and the level shifter may modulate the pulse width of the clock signal when the pulse width of the second reference signal is equal to or more than the predetermined reference pulse width.

The reference signal generation circuit may further supply a clock select signal to the level shifter, and the level shifter may modulate the pulse width of the clock signal when the clock select signal is inputted.

In another embodiment, a display device comprising: a OLED display panel comprising a plurality of data lines, a plurality of gate lines, and a plurality of sub pixels defined by the plurality of data lines and the plurality of gate lines, a data driving circuit configured to supply image data and fake data to a plurality of data lines; a level shifter configured to supply a plurality of clock signals; and a gate driving circuit configured to supply gate signals to a plurality of gate lines based on the plurality of clock signals, wherein the data driving circuit supplies the fake data to the plurality of data lines before the gate signal for an (n+1)th gate line is supplied after the gate signal for an n-th gate line is supplied, and wherein a turn-on level period of the gate signal for the n-th gate line comprises an overlap period that overlaps a turn-on level period of the gate signal for an (n−1)th gate line and a non-overlap period that does not overlap the turn-on level period of the gate signal for the (n−1)th gate line.

In further embodiment, a method for driving a display device, the display device comprising the display panel comprising a plurality of data lines, a plurality of gate lines, and a plurality of sub pixels defined by the plurality of data lines and the plurality of gate lines, the method comprising: supplying image data and fake data to the plurality of data lines; supplying a level shifter with a first reference signal and a second reference signal for generating a plurality of clock signals; and supplying a gate driving circuit with the plurality of clock signals for generating gate signals supplied to the plurality of gate lines; wherein a turn-on level period of the gate signal for an n-th gate line comprises an overlap period that overlaps a turn-on level period of the gate signal for an (n−1)th gate line and a non-overlap period that does not overlap a turn-on level period of the gate signal for the (n−1)th gate line, and wherein the level shifter modulates the pulse width of the clock signal corresponding to the gate signal for the n-th gate line among the plurality of clock signals, such that the magnitude of the gate signal of the non-overlap period for the n-th gate line is retained as a smaller magnitude than that of the gate signal of the overlap period for the n-th gate line.

DETAILED DESCRIPTION

Figure 1:
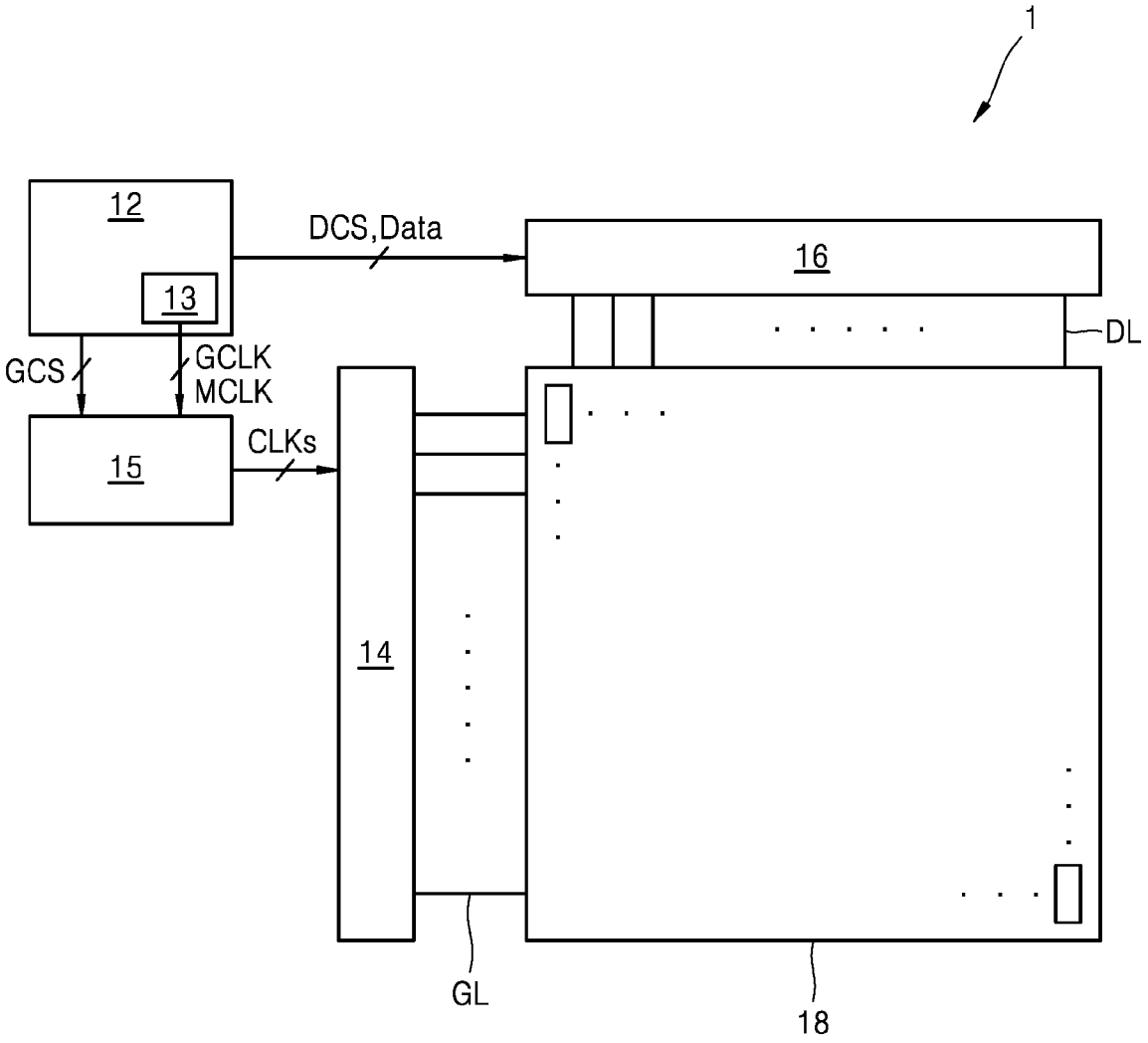
FIG. 1 is a configuration diagram of a display device according to an embodiment of the present disclosure.

The above-described features and advantages will be described below in detail with reference to the accompanying drawings. Thus, the technical idea of the present disclosure can be easily carried out by those skilled in the art to which the present disclosure pertains. In describing the various embodiments of the present disclosure, detailed descriptions for publicly known functions or configurations the present disclosure will be ruled out in order not to unnecessarily obscure subject matters of the present disclosure. Hereafter, embodiments of the present disclosure will be described in detail with reference to the accompanying drawings. The same reference numerals in the drawings are used to represent like or similar components.

FIG. 1 is a configuration diagram of a display device according to an embodiment of the present disclosure.

Referring to FIG. 1, the display device 1 according to the embodiment of the present disclosure includes a display panel 18 to display an image. On the display panel 18, a plurality of data lines DL and a plurality of gate lines GL are arranged so as to cross each other. Hereafter, it is defined that the plurality of data lines DL are disposed as columns, and the plurality of gate lines GL are disposed as rows. Depending on embodiments, however, it may be defined that the plurality of data lines DL are disposed as rows, and the plurality of gate lines GL are disposed as columns.

The plurality of data lines DL and the plurality of gate lines GL cross each other to define sub pixel areas in a matrix shape. Each of the sub pixel areas has a sub pixel SP disposed therein.

Each of the sub pixels SP includes a thin film transistor (TFT). Through the TFT included in each of the sub pixels SP, a data voltage is supplied from a data driving circuit 16. When the display device 1 is a liquid crystal display (LCD), the sub pixel SP may include a liquid crystal capacitor of which the liquid crystal molecular arrangement is varied according to a data voltage supplied thereto. When the display device 1 is an organic light emitting diode (OLED) display device, the sub pixel SP may include an OLED that self-emits light using a data voltage supplied thereto.

The data driving circuit 16 receives a data control signal DCS and image data Data from a timing control circuit 12. The data driving circuit 16 converts the image data Data received from the timing control circuit 12 into an analog data voltage, based on the data control signal DCS, and supplies the data voltage to the plurality of data lines DL.

The data driving circuit 16 may include one or more source driver integrated circuits. The one or more source driver integrated circuits may be connected to a bonding pad of the display panel 18 through a TAB (Tape Automated Bonding) method or COG (Chip On Glass) method, directly disposed on the display panel 18, or integrated and disposed on the display panel 18.

The one or more source driver integrated circuits may be implemented through a COF (Chip On Film) method. In this case, one end of a film on which each of the source driver integrated circuits is mounted is bonded to one or more source printed circuit boards, and the other end of the film is bonded to the display panel 18.

A gate driving circuit 14 generates scan signals based on a plurality of clock signals CLKs supplied from a level shifter 15, and sequentially supplies the generated scan signals to the plurality of gate lines GL.

The gate driving circuit 14 may include one or more gate driver integrated circuits. The one or more gate driver integrated circuits may be connected to the bonding pad of the display panel 18 through the TAB method or the COG method, or implemented in a GIP (Gate In Panel) type and directly disposed on the display panel 18. Furthermore, the gate driving circuit 14 may be integrated and disposed on the display panel 18, or implemented through a COF (Chip On Film) method of mounting the gate driving circuit 14 on a film connected to the display panel 18.

The timing control circuit 12 receives image data inputted from an external device, and converts the received image data into data suitable for an operation of the data driving circuit 16. The converted image data Data is supplied to the data driving circuit 16 with the data control signal DCS.

The timing control circuit 12 generates the data control signal DCS and the gate control signal GCS using synchronization signals inputted from the external device, for example, a dot clock DCLK, a data enable signal DE, a horizontal synchronization signal Hsync and a vertical synchronization signal Vsync, and supplies the generated data control signal DCS and gate control signal GCS to the data driving circuit 16 and the gate driving circuit 14, respectively. In particular, the timing control circuit 12 includes a reference signal generation circuit 13 configured to generate reference signals GCLK and MCLK for the level shifter 15 to generate the plurality of clock signals CLKs.

The level shifter 15 generates the plurality of clock signals CLKs based on the gate control signal GCS and the reference signals GCLK and MCLK which are supplied from the timing control circuit 12. The reference signals include a first reference signal GCLK corresponding to rising edges of the respective clock signals CLKs and a second reference signal MCLK corresponding to falling edges of the respective clock signals CLKs, when the plurality of clock signals CLKs are generated.

Figure 2:
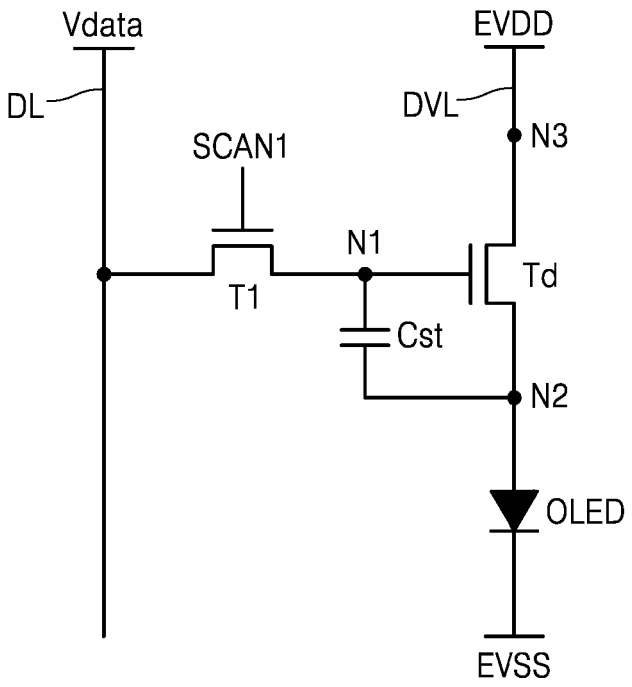
FIG. 2 is a circuit diagram of a sub pixel disposed in a display panel according to an embodiment of the present disclosure.
Figure 3:
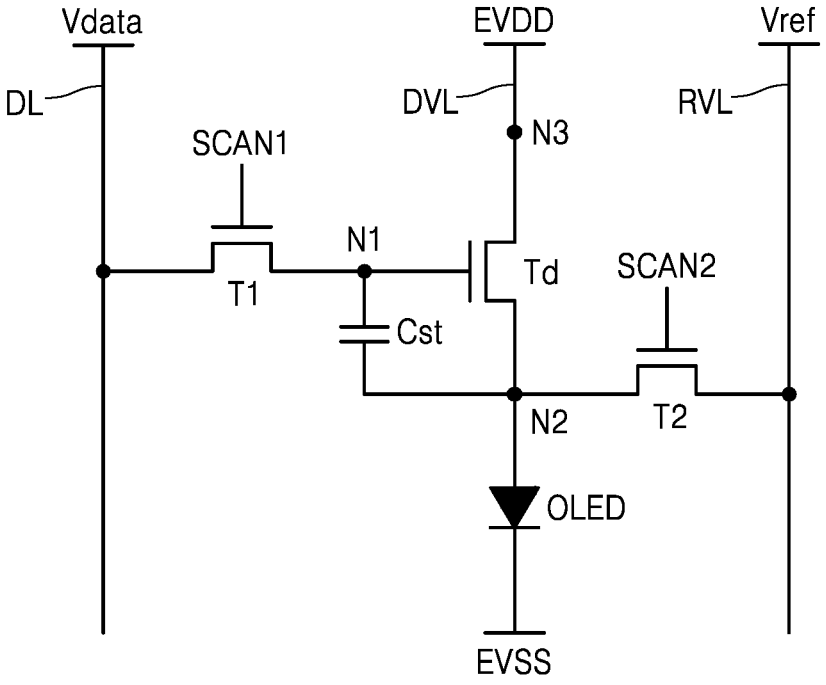
FIG. 3 is a circuit diagram of a sub pixel disposed in a display panel according to another embodiment of the present disclosure.

Hereafter, a circuit configuration and driving process of the sub pixel SP disposed in the display panel according to the embodiment of the present disclosure will be described with reference to FIGS. 2 and 3. For reference, FIGS. 2 and 3 illustrate the circuit configuration of the sub pixel SP when the display device according to the embodiment of the present disclosure is an OLED display device. However, the circuit configuration of the sub pixel SP may be changed depending on the type of the display device.

FIG. 2 is a circuit diagram of the sub pixel disposed in the display panel according to the embodiment of the present disclosure, and FIG. 3 is a circuit diagram of a sub pixel disposed in a display panel according to another embodiment of the present disclosure.

Referring to FIG. 2, each of the sub pixels PS includes an OLED having first and second electrodes, a driving transistor Td for driving the OLED, a first transistor T1 electrically coupled between a first node N1 of the driving transistor Td and a data line DL, and a storage capacitor Cst electrically coupled between the first node N1 and a second node N2 of the driving transistor Td.

The OLED includes the first electrode (for example, anode or cathode electrode), an organic light emitting layer and the second electrode (for example, cathode or anode electrode).

The first electrode of the OLED is electrically coupled to the second node N2 of the driving transistor Td. A base voltage EVSS is applied to the second electrode of the OLED. Examples of the base voltage EVSS may include a ground voltage or a voltage similar to the ground voltage.

The driving transistor Td supplies a driving current to the OLED. When the OLED is driven by the supply of the driving current, the organic light emitting layer included in the OLED emits light to display an image.

The driving transistor Td includes the first node N1, the second node N2 and a third node N3.

The first node N1 of the driving transistor Td is a gate node which is electrically coupled to a source node or drain node of the first transistor T1. The second node N2 of the driving transistor Td may be electrically coupled to the first electrode of the OLED, and serve as a source node or drain node.

The third node N3 of the driving transistor Td, to which a driving voltage EVDD is applied, may be electrically coupled to a driving voltage line DVL for supplying the driving voltage EVDD, and serve as a drain node or source node. The following descriptions will be based on the supposition that the second node N2 of the driving transistor Td is the source node and the third node N3 of the driving transistor Td is the drain node.

The drain node or source node of the first transistor T1 is electrically coupled to the data line DL, and the source node or drain node of the first transistor T1 is electrically coupled to the first node N1 of the driving transistor Td. The gate node of the first transistor T1 may be electrically coupled to a gate line, and a first scan signal SCAN1 may be supplied to the gate node of the first transistor T1 through the gate line.

When the first scan signal SCAN1 is applied, the first transistor T1 is turned on to transfer a data voltage Vdata supplied through the data line DL to the first node N1 of the driving transistor Td through the first transistor T1.

The storage capacitor Cst is electrically coupled between the first and second nodes N1 and N2 of the driving transistor Td, and retains the data voltage Vdata corresponding to an image signal or a voltage corresponding to the data voltage Vdata for one frame time.

As illustrated in FIG. 2, the sub pixel SP including two transistors Td and T1 and one storage capacitor Cst may be referred to as a sub pixel having a 2T (Transistor)-1C (Capacitor) structure.

In an embodiment, a sub pixel SP having a 3T1C structure illustrated in FIG. 3 may be disposed on the display panel 18, instead of the sub pixel SP having the 2T1C structure illustrated in FIG. 2.

Referring to FIG. 3, the sub pixel SP having the 3T1C structure may further include a second transistor T2 which is electrically coupled between a reference voltage line RVL and the second node N2 of the driving transistor Td of the sub pixel SP having the 2T1C structure illustrated in FIG. 2.

The second transistor T2 is electrically coupled between the second node N2 of the driving transistor Td and the reference voltage line RVL, and a gate line is coupled to a gate node of the second transistor T2. Through the gate line, a second scan signal SCAN2 may be supplied to the gate node of the second transistor T2.

Furthermore, a drain node or source node of the second transistor T2 is electrically coupled to the reference voltage line RVL, and the source node or drain node of the second transistor T2 is electrically coupled to the second node N2 of the driving transistor Td.

In the embodiment of the present disclosure, the second transistor T2 may be turned on during a displaying operation of the display device, or turned on during a sensing operation for sensing a characteristic value of the driving transistor Td or a characteristic value of the OLED.

The second transistor T2 may be turned on by the second scan signal SCAN2 according to voltage reset timing of the second node N2 of the driving transistor Td during the displaying operation or the sensing operation. At this time, when the second transistor T2 is turned on, a reference voltage Vref is supplied to the second node N2 of the driving transistor Td through the reference voltage line RVL.

Furthermore, the second transistor T2 may be turned on by the second scan signal SCAN2 according to sampling timing during the sensing operation. At this time, when the second transistor T2 is turned on, the voltage of the second node N2 of the driving transistor Td is transferred to the reference voltage line RVL.

The second transistor T2 serves to adjust the voltage magnitude of the second node N2 of the driving transistor Td, or transfer the voltage of the second node N2 of the driving transistor Td to the reference voltage line RVL.

The reference voltage line RVL may be electrically coupled to an analog-digital converter that senses the voltage of the reference voltage line RVL, converts the sensed voltage into a digital value, and outputs sensing data including the digital value. The analog-digital converter may be included in the data driving circuit 16. The sensing data outputted from the analog-digital converter may be used to sense a characteristic value (for example, threshold voltage or mobility) of the driving transistor Td or a characteristic value (for example, threshold voltage) of the OLED.

The storage capacitor Cst may be implemented as an external capacitor which is intentionally disposed outside the driving transistor Td, instead of a parasitic capacitor (for example, Cgs or Cgd) which is an internal capacitor present between the first and second nodes N1 and N2 of the driving transistor Td.

Each of the driving transistor Td, the first transistor T1 and the second transistor T2 may be an n-type transistor or p-type transistor.

The first scan signal SCAN1 and the second scan signal SCAN2 may be different gate signals. In this case, the first scan signal SCAN1 and the second scan signal SCAN2 are applied to the gate node of the first transistor T1 and the gate node of the second transistor T2 through different gate lines, respectively.

In an embodiment, the first scan signal SCAN1 and the second scan signal SCAN2 may be the same gate signal. In this case, the first scan signal SCAN1 and the second scan signal SCAN2 are applied to the gate node of the first transistor T1 and the gate node of the second transistor T2 through the same gate line.

Each of the sub pixel structures illustrated in FIGS. 2 and 3 is one embodiment, and the sub pixel SP according to the another embodiment of the present disclosure may include an additional transistor and/or capacitor. In an embodiment, the plurality of sub pixels may have the same circuit configuration, and some of the plurality of sub pixels may have a different circuit configuration.

The driving process of the sub pixel SP having the circuit configuration illustrated in FIG. 3 will be described as follows.

The driving process of each sub pixel SP is divided into an image data writing step, a boosting step and a light emitting step.

In the image data writing step, the image data voltage Vdata is applied to the first node N1 of the driving transistor Td, and the reference voltage Vref is applied to the second node N2 of the driving transistor Td. Due to a resistance element between the second node N2 of the driving transistor Td and the reference voltage line RVL, a voltage Vref+ΔV similar to the reference voltage Vref may be applied to the second node N2 of the driving transistor Td.

Then, the first and second scan signals SCAN1 and SCAN2 having a turn-on voltage level may be applied to the respective gate nodes of the first and second transistors T1 and T2, such that the first and second transistors T1 and T2 are turned on at the same time or with a slight time difference therebetween. Therefore, an electric charge corresponding to a voltage difference (Vdata−Vref or Vdata−(Vref+4V)) between the first and second nodes N1 and N2 is stored in the storage capacitor Cst.

An operation of applying the image data voltage Vdata to the first node N1 of the driving transistor Td through such a process is referred to as image data writing.

In the boosting step following the image data writing step, the first and second nodes N1 and N2 of the driving transistor Td electrically float at the same time or with a slight time difference therebetween.

Then, when the first scan signal SCAN1 having a turn-off voltage level is applied to the gate node, the first transistor T1 is turned off. Furthermore, the second transistor T2 is turned off by the second scan signal SCAN2 having the turn-off voltage level.

In the boosting step, the voltage between the first and second nodes N1 and N2 of the driving transistor Td is boosted or increased, while the voltage difference between the first and second nodes N1 and N2 of the driving transistor Td is retained.

When the voltage of the second node N2 of the driving transistor Td becomes equal to or more than a predetermined voltage while the voltage between the first and second nodes N1 and N2 of the driving transistor Td is boosted, the sub pixel enters the light emitting step.

In the light emitting step, a driving current having a magnitude corresponding to the image data voltage Vdata flows through the OLED. As the driving current drives the organic light emitting layer of the OLED to emit light, an image is displayed through the display panel 18.

Hereafter, a method for driving a display device according to an embodiment of the present disclosure will be described in detail.

Figure 4:
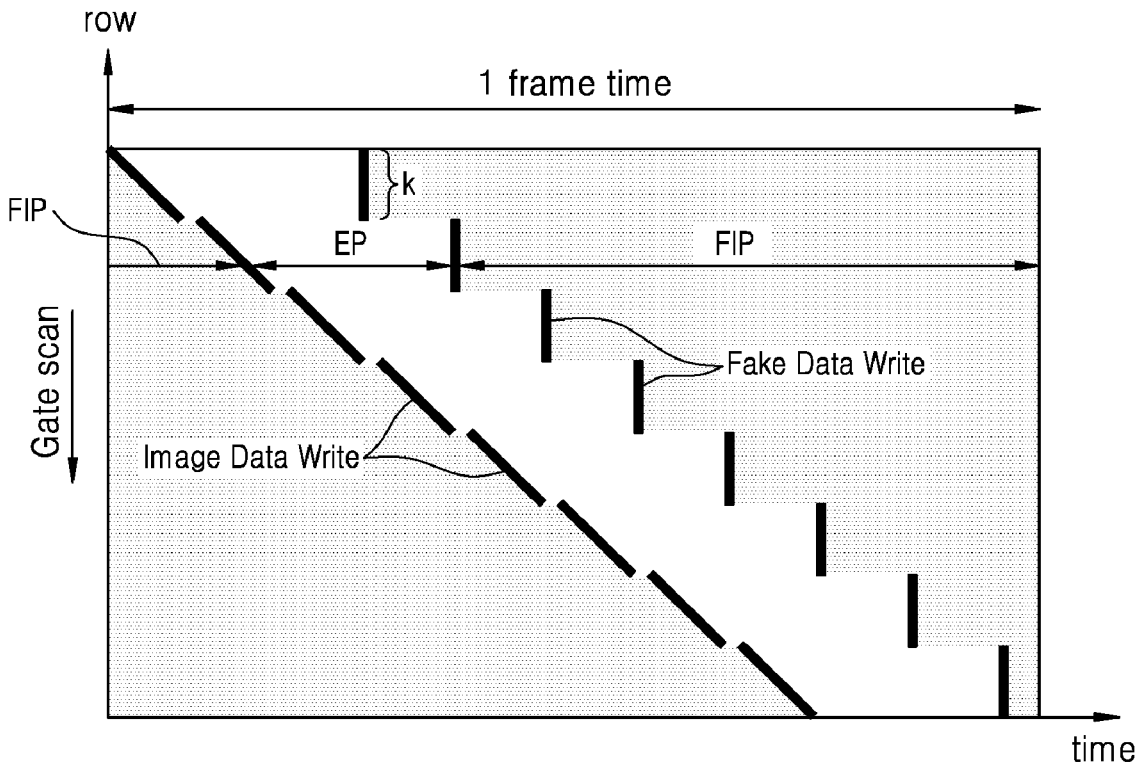
FIG. 4 illustrates an emission period and a fake image period when one frame of image is displayed through the display device according to the embodiment of the present disclosure.
Figure 5:
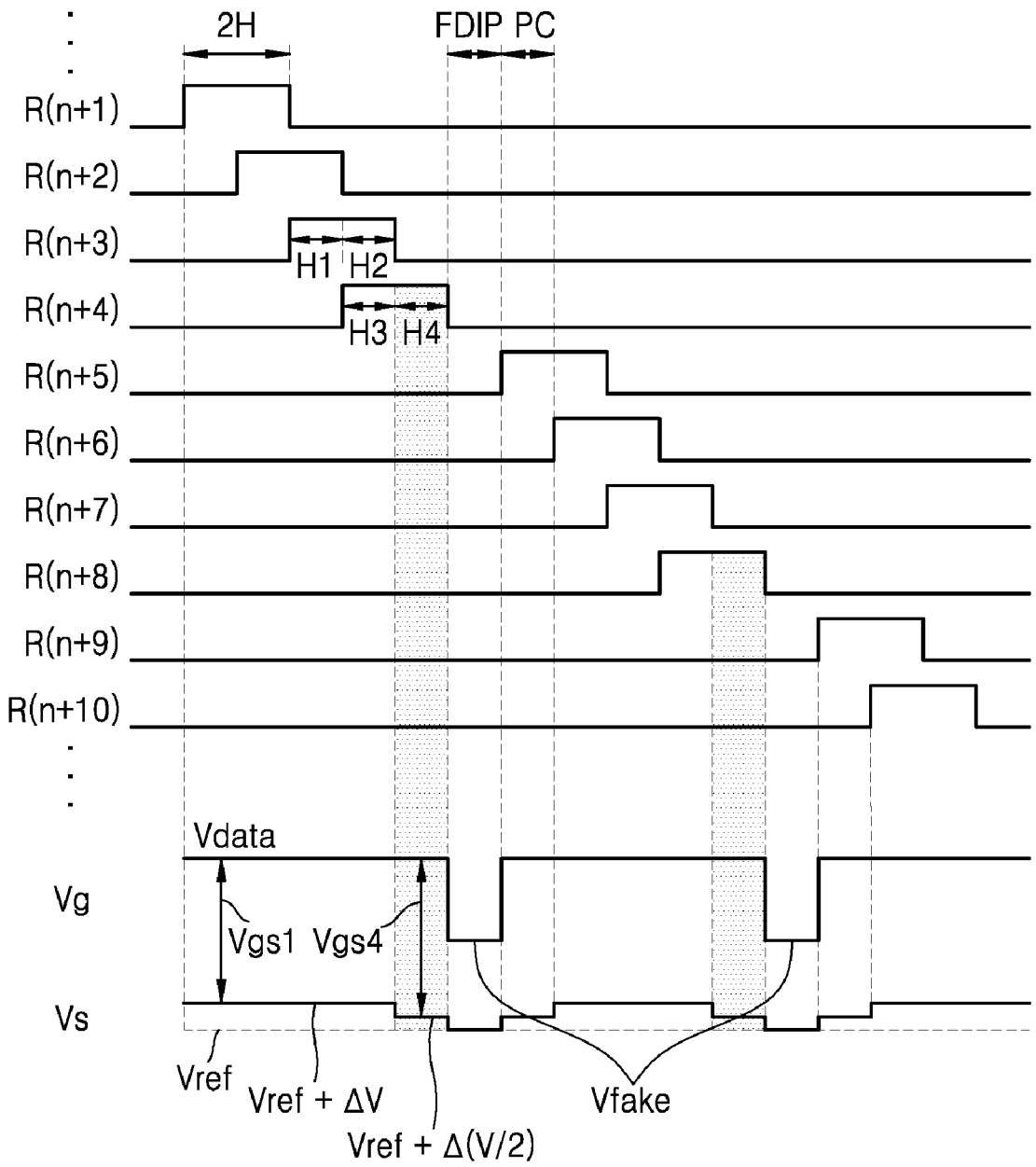
FIG. 5 illustrates the waveforms of gate signals and the waveform of a gate-source voltage Vgs of a driving transistor coupled to a sub pixel for each gate line during a 2H overlap operation and a fake data insertion operation of the display device according to the embodiment of the present disclosure.

FIG. 4 illustrates an emission period and a fake image period when one frame of image is displayed through the display device according to the embodiment of the present disclosure. FIG. 5 illustrates the waveforms of gate signals and the waveform of a gate-source voltage Vgs of the driving transistor coupled to the sub pixel for each of the gate lines, during a 2H overlap operation and a fake data insertion operation of the display device according to the embodiment of the present disclosure.

In the drawings, as described above, Row or . . . , R(n+1), R(n+2), R(n+3), R(n+4), R(n+5), . . . represent sub pixel rows Row which are constituted by the sub pixels SP arranged in a matrix shape on the display panel 18 or the gate lines GL coupled to the sub pixels SP arranged in the respective sub pixel rows Row (n=0, 1, 2, . . . ). The gate signals are sequentially supplied to the respective sub pixel rows Row or the respective gate lines GL corresponding to the sub pixel rows Row by the gate driving circuit 14.

FIG. 4 illustrates the emission period EP in which an actual image is displayed for one frame time and the fake image period FIP in which no image is displayed, according to the sequential supply of the gate signals.

The top of FIG. 5 illustrates the waveforms of the gate signals which are sequentially supplied to the respective sub pixel rows Row ( . . . , R(n+1), R(n+2), R(n+3), R(n+4), R(n+5), . . . ), and the bottom of FIG. 5 illustrates the voltage Vg of the first node N1 of the driving transistor Td included in the sub pixels SP disposed in the respective sub pixel rows Row ( . . . , R(n+1), R(n+2), R(n+3), R(n+4), R(n+5), . . . ), i.e., the gate node, and the voltage Vs of the second node N2, i.e., the source node, according to the sequential supply of the gate signals.

Hereafter, the voltage between the voltage Vg of the first node N1 of the driving transistor Td, i.e., the gate node, and the voltage Vs of the second node N2, i.e., the source node is referred to as a gate-source voltage Vgs.

When each of the sub pixels SP has the 3T1C circuit structure, one or two gate lines GL for transferring the first and second scan signals SCAN1 and SCAN2 may be disposed in the sub pixels SP arranged in each of the sub pixel rows . . . , R(n+1), R(n+2), R(n+3), R(n+4), R(n+5), . . . . For reference, FIG. 5 illustrates the waveform of one scan signal (the first scan signal SCAN1 or the second scan signal SCAN2) supplied to each gate line GL, for convenience of description.

According to the above-described driving process of the sub pixel SP, when an (n+1)th sub pixel row R(n+1) among the plurality of sub pixel rows . . . , R(n+1), R(n+2), R(n+3), R(n+4), R(n+5), . . . is driven, the first and second scan signals SCAN1 and SCAN2 are applied to the sub pixels SP arranged in the (n+1)th sub pixel row R(n+1), and the image data voltage Vdata is supplied to the sub pixels SP arranged in the (n+1)th sub pixel row R(n+1) through the plurality of data lines DL.

Then, the (n+2)th sub pixel row R(n+2) positioned under the (n+1)th sub pixel row R(n+1) is driven. The first and second scan signals SCAN1 and SCAN2 are applied to the sub pixels SP arranged in the (n+2)th sub pixel row R(n+2), and the image data voltage Vdata is supplied to the sub pixels SP arranged in the (n+2)th sub pixel row R(n+2) through the plurality of data lines DL.

In this way, image data writing operations on the plurality of sub pixel rows . . . , R(n+1), R(n+2), R(n+3), R(n+4), R(n+5), . . . are sequentially performed.

According to the above-described sub pixel driving operation for one frame time, the image data writing step, the boosting step and the light emitting step may be sequentially performed in each of the sub pixel rows . . . , R(n+1), R(n+2), R(n+3), R(n+4), R(n+5), . . . .

As illustrated in FIG. 4, the emission periods EP of the respective sub pixel rows . . . , R(n+1), R(n+2), R(n+3), R(n+4), R(n+5), . . . within one frame time do not last to the end. That is, the emission period EP in which an actual image is displayed and the fake image period FIP in which data is displayed instead of an actual image, that is, an fake data insertion (FDI) operation is performed are executed in each of the sub pixel rows . . . , R(n+1), R(n+2), R(n+3), R(n+4), R(n+5), . . . for one frame time.

During the emission period EP, the image data voltages Vdata corresponding to images which are to be actually displayed on the sub pixels SP arranged in the respective sub pixel rows . . . , R(n+1), R(n+2), R(n+3), R(n+4), R(n+5), . . . are supplied, and the image data writing step, the boosting step and the light emitting step are performed to drive the OLED to emit light.

During the following fake image period FIP, a fake image is displayed through the fake data insertion operation of supplying each of the sub pixels SP with a fake data voltage Vfake corresponding to an image irrelevant to the image which is to be actually displayed, that is, the fake image. Examples of the fake data may include black data, but the fake data is not necessarily limited to the black data.

The period in which the fake data insertion operation FDI is performed is referred to as a fake data insertion period FDIP, and the period in which a fake image is displayed by the fake data insertion operation FDI is referred to as the fake image period FIP.

The above-described fake data insertion operation may be performed on a basis of one sub pixel row or a plurality of sub pixel rows.

In the embodiments illustrated in FIGS. 4 and 5, image data writing may be sequentially performed on the sub pixel row R(n+1), the sub pixel row R(n+2), the sub pixel row R(n+3) and the sub pixel row R(n+4), and then the fake data voltage Vfake may be concurrently supplied to a plurality of sub pixel rows which are disposed before the sub pixel row R(n+1) and have already passed the predetermined emission period EP.

Then, image data writing may be sequentially performed on the sub pixel row R(n+5), the sub pixel row R(n+6), the sub pixel row R(n+7) and the sub pixel row R(n+8), and then the fake data voltage Vfake may be concurrently supplied to the plurality of sub pixel rows which are disposed before the sub pixel row R(n+1) or R(n+5) and have already passed the predetermined emission period EP.

For reference, the number k of sub pixel rows in which the fake data insertion operation is performed at the same time may be constantly maintained or changed. For example, the fake data insertion operation may be performed on first two sub pixel rows at the same time, and then performed on a basis of four sub pixel rows at the same time. For another example, the fake data insertion operation may be performed on first four sub pixel rows at the same time, and then performed on a basis of eight sub pixel rows at the same time.

When such a fake data insertion operation FDI is performed, image data to be actually displayed and fake data are displayed for one frame time, which makes it possible to reduce the above-described motion blur.

When fake data writing is performed in a plurality of sub pixel rows at the same time, it is possible to compensate for a luminance deviation caused by a difference in emission period EP between line positions, and to secure an image data writing time for the next sub pixel row.

Furthermore, by controlling the timing of the fake data insertion operation, it is possible to adaptively adjust the length of the emission period EP depending on an image.

The display device 1 according to the embodiment of the present disclosure performs an overlap operation with the above-described fake data insertion operation, in order to improve the voltage charge ratio of each of the sub pixels SP in the image display process. The overlap operation will be described below.

As illustrated in FIG. 5, the turn-on level periods of the scan signals which are sequentially supplied to the respective sub pixel rows . . . , R(n+1), R(n+2), R(n+3), R(n+4), R(n+5), . . . have a length of 2H. Furthermore, the turn-on level periods of the scan signals which are supplied to the respective sub pixel rows . . . , R(n+1), R(n+2), R(n+3), R(n+4), R(n+5), . . . overlap each other.

For example, the turn-on level period of the scan signal applied to the (n+3)th sub pixel row R(n+3) is divided into a first period H1 and a second period H2, and the first period H1 overlaps the scan signal applied to the (n+2)th sub pixel row R(n+2) by 1H.

Similarly, the second period H2 overlaps the scan signal applied to the (n+4)th sub pixel row R(n+4) by 1H.

In the embodiment of the present disclosure, the section of the turn-on level period of the scan signal, which overlaps another scan signal, such as the first period H1 and the second period H2, is referred to as an overlap period. Therefore, the turn-on level period of the scan signal applied to the (n+3)th sub pixel row R(n+3) is composed of overlap periods.

On the other hand, the turn-on level period of the scan signal applied to the (n+4)th sub pixel row R(n+4) is divided into a third period H3 and a fourth period H4, and the third period H3 overlaps the second period H2 of the scan signal applied to the (n+3)th sub pixel row R(n+3) by 1H.

However, the fourth period H4 does not overlap another scan signal. This is because, as illustrated in FIG. 5, the scan signal for the (n+5)th sub pixel row R(n+5) is not applied immediately after the scan signal for the (n+4)th sub pixel row R(n+4) is applied, but the fake data insertion period FDIP in which the fake data insertion operation is performed is executed.

In the embodiment of the present disclosure, the section of the turn-on level period of the scan signal, which does not overlap another scan signal, such as the fourth period H4, is referred to as a non-overlap period. Therefore, the turn-on level period of the scan signal applied to the (n+4)th sub pixel row R(n+4) is composed of an overlap period and a non-overlap period.

When the fake data insertion period FDIP is ended, the scan signal for the (n+5)th sub pixel row R(n+5) is applied, and a precharge operation PC for the sub pixels SP arranged in the (n+5)th sub pixel row R(n+5) is performed in a non-overlap period of the scan signal for the (n+5)th sub pixel row R(n+5).

The display device 1 according to the embodiment of the present disclosure may perform the above-described overlap operation to raise the voltage charge ratios of the respective sub pixels SP during the image display process.

For reference, FIG. 5 illustrates the embodiment in which each of the scan signals has a length of 2H, the overlap period has a length of 1H, and the fake data insertion period FDIP is executed whenever the applying of the scan signals to four sub pixel rows is completed. In an embodiment, however, the length of each of the scan signals may be changed to 3H, 4H, . . . , and the length of the overlap period may also be changed to 2H, 3H, . . . . In an embodiment, the fake data insertion period FDIP may be executed whenever the applying of the scan signals to eight sub pixel rows or ten sub pixel rows is completed. Hereafter, the driving process of the display device 1 according to the embodiment of the present disclosure will be described based on the embodiment of FIG. 5, for convenience of description.

FIG. 5 illustrates magnitude changes of the gate node voltage Vg and the source node voltage Vs of the driving transistor Td included in each of the sub pixels SP arranged in each of the sub pixel rows . . . , R(n+1), R(n+2), R(n+3), R(n+4), R(n+5), before the boosting step, when the above-described overlap operation is performed. As described above, a difference between the gate node voltage Vg and the source node voltage Vs of the driving transistor Td may be referred to as the gate-source voltage Vgs.

Referring to FIG. 5, the gate node voltages Vg of the driving transistors Td of the sub pixels included in each of the sub pixel rows in the other periods excluding the fake data insertion period FDIP retain the same magnitude as the image data voltage Vdata, with the progress of the image data writing.

However, during the fake data insertion period FDIP, the gate node voltages Vg of the driving transistors Td of the sub pixels included in the sub pixel rows where the fake data insertion FDI is performed become the fake data voltage Vfake.

Furthermore, the source node voltages Vs of the driving transistors Td of the sub pixels included in each of the sub pixel rows in the other periods excluding the fake data insertion period FDIP retain the magnitude of a voltage Vref+ΔV similar to the reference voltage, with the progress of the image data writing.

However, the turn-on level period of a specific scan signal, for example, the scan signal applied to the (n+4)th sub pixel row R(n+4) includes the non-overlap period H4. As illustrated in FIG. 5, the source node voltage Vs of the driving transistor Td in the non-overlap period H4 exhibits the magnitude of a voltage Vref+Δ(V/2) which has decreased from the magnitude of the previous voltage Vref+ΔV.

Due to such a phenomenon, the gate-source voltage Vgs of the driving transistor Td is constantly retained as (Vdata−(Vref+ΔV)) during the turn-on level periods of the scan signals applied to the (n+1)th sub pixel row R(n+1), the (n+2)th sub pixel row R(n+2) and the (n+3)th sub pixel row R(n+3). However, the gate-source voltage Vgs of the driving transistor Td in the non-overlap period H4 of the turn-on level period of the scan signal applied to the (n+4)th sub pixel row R(n+4) increases to Vdata−(Vref+Δ(V/2)).

For example, the gate-source voltage Vgs4 of the driving transistor Td in the non-overlap period H4 of the turn-on level period of the scan signal applied to the (n+4)th sub pixel row R(n+4) may be larger than the gate-source voltage Vgs1 of the driving transistor Td of the (n+1)th sub pixel row R(n+1).

When the gate-source voltage Vgs of the driving transistor Td increases, the magnitude of the driving current flowing through the driving transistor Td increases. Thus, the brightness of the OLED also increases.

Therefore, when an image is displayed through the overlap operation according to the embodiment of the present disclosure, a line corresponding to a specific sub pixel row (for example, R(n+4), R(n+8), . . . ) becomes excessively bright in comparison to the other lines.

Hereafter, an embodiment for solving the above-described problem that a specific line becomes excessively bright when an image is displayed will be described.

Figure 6:
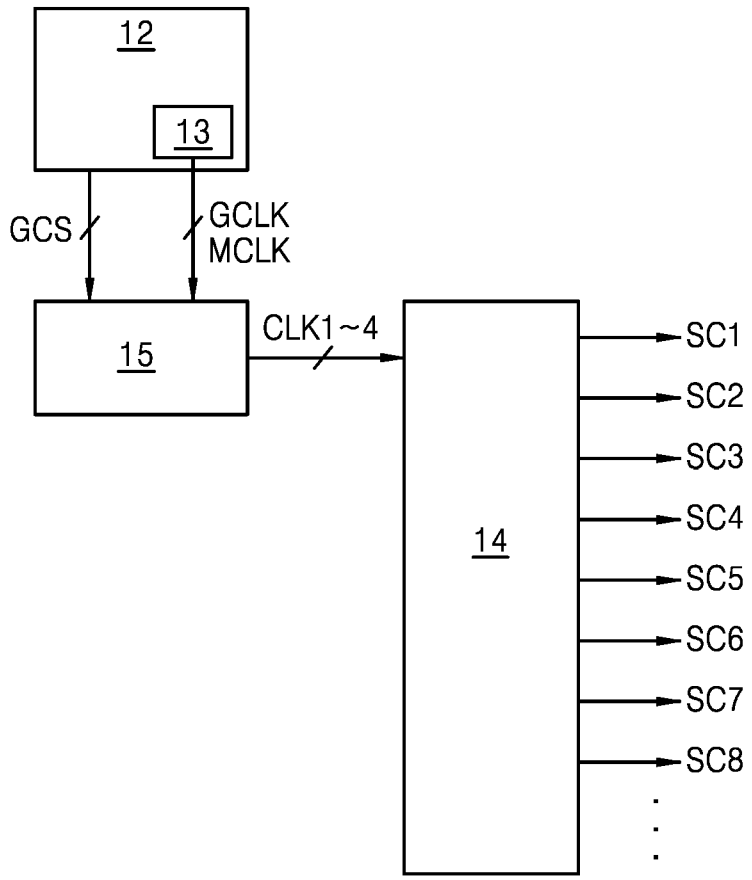
FIG. 6 illustrates a timing control circuit, a level shifter and a gate driving circuit which are included in the display device according to the embodiment of the present disclosure.
Figure 7:
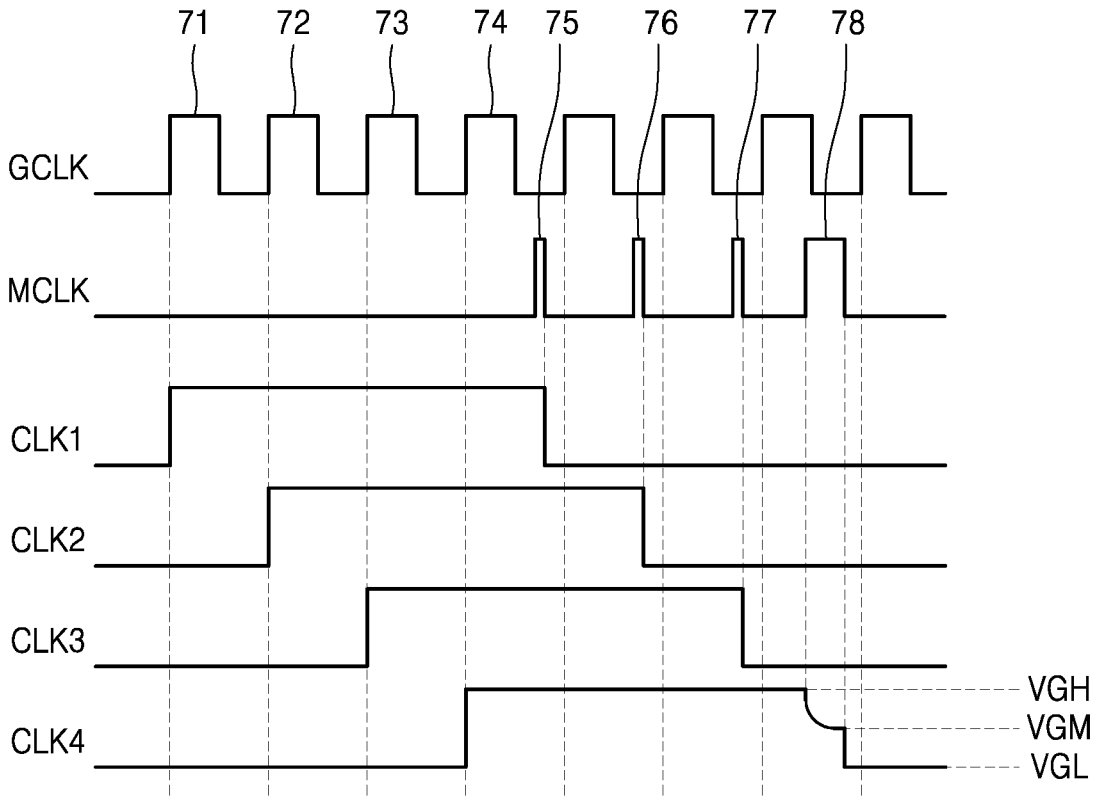
FIG. 7 illustrates the waveforms of clock signals generated by the level shifter of FIG. 6.
Figure 8:
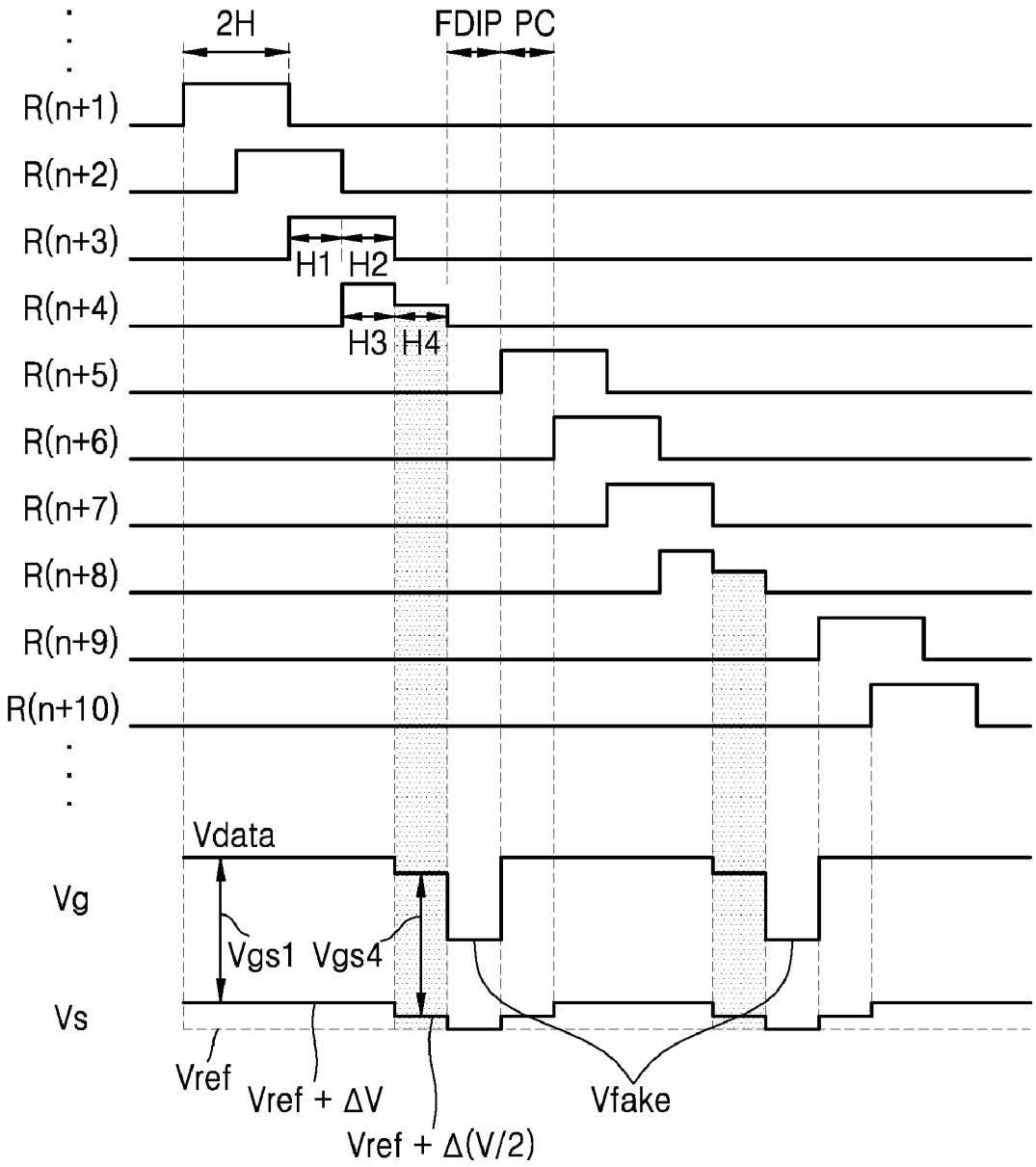
FIG. 8 illustrates the waveforms of gate signals and the waveform of a gate-source voltage Vgs of a driving transistor coupled to a sub pixel for each gate line during a 2H overlap operation and a fake data insertion operation of the enhanced display device of FIG. 7 according to the embodiment of the present disclosure.

FIG. 6 illustrates the timing control circuit, the level shifter and the gate driving circuit which are included in the display device according to the embodiment of the present disclosure. FIG. 7 illustrates the waveforms of clock signals generated by the level shifter of FIG. 6. FIG. 8 illustrates the waveforms of gate signals and the waveform of the gate-source voltage Vgs of the driving transistor coupled to the sub pixel for each of the gate lines, during a 2H overlap operation and a fake data insertion operation of the enhanced display device of FIG. 7 according to the embodiment of the present disclosure.

Referring to FIG. 6, the display device according to the embodiment of the present disclosure includes a timing control circuit 12, a level shifter 15 and a gate driving circuit 14. The timing control circuit 12 includes a reference signal generation circuit 13.

The timing control circuit 12 supplies a gate control signal GCS and reference signals GCLK and MCLK to the level shifter 15. The gate control signal GCS may be transferred to the gate driving circuit 14 through the level shifter 15, or not passed through the level shifter 15 but directly transferred to the gate driving circuit 14 from the timing control circuit 12.

The reference signals GCLK and MCLK include a first reference signal GCLK and a second reference signal MCLK. The first reference signal GCLK and the second reference signal MCLK are generated by the reference signal generation circuit 13, and supplied to the level shifter 15.

The level shifter 15 generates a plurality of clock signals based on the first and second reference signals GCLK and MCLK which are generated and supplied by the reference signal generation circuit 13. For example, as illustrated in FIG. 7, the level shifter 15 may generate four clock signals, i.e., a first clock signal CLK1, a second clock signal CLK2, a third clock signal CLK3 and a fourth clock signal CLK4, based on the first reference signal GCLK and the second reference signal MCLK. In an embodiment, however, the level shifter 15 may generate less than four clock signals or five or more clock signals.

The gate driving circuit 14 generates gate signals SC1, SC2, SC3, SC4, . . . based on the first to fourth clock signals CLK1 to CLK4 which are generated and supplied by the level shifter 15. Hereafter, an embodiment in which first to fourth gate signals SC1 to SC4 are generated based on the first to fourth clock signals CLK1 to CLK4, respectively, and fifth to eighth gate signals SC5 to SC8 are generated based on the first to fourth clock signals CLK1 to CLK4, respectively, will be taken as an example for description. However, the number of clock signals inputted to the gate driving circuit 14 and the types and number of gate signals generated in response to the respective clock signals may differ depending on embodiments.

Referring to FIG. 6, the level shifter 15 according to the embodiment of the present disclosure generates four clock signals, i.e., the first to fourth clock signals CLK1 to CLK4, based on the first reference signal GCLK and the second reference signal MCLK which are sequentially inputted with a predetermined time interval.

For example, the level shifter 15 generates the first clock signal CLK1 having a rising edge corresponding to a rising edge of a first first reference signal 71. Furthermore, a falling edge of the first clock signal CLK1 generated by the level shifter 15 corresponds to a falling edge of a first second reference signal 75.

In a similar way, the level shifter 15 generates the second clock signal CLK2 having a rising edge corresponding to a rising edge of a second first reference signal 72 and a falling edge corresponding to a falling edge of a second second reference signal 76, the third clock signal CLK3 having a rising edge corresponding to a rising edge of a third first reference signal 73 and a falling edge corresponding to a falling edge of a third second reference signal 77, and the fourth clock signal CLK4 having a rising edge corresponding to a rising edge of a fourth first reference signal 74 and a falling edge corresponding to a falling edge of a fourth second reference signal 78.

Through such a process, the level shifter 15 generates the first to fourth clock signals CLK1 to CLK4 which are sequentially delayed by the cycle of the first reference signal GCLK.

The level shifter 15 according to the embodiment of FIGS. 6 and 7 may include a modulation circuit for modulating the pulse width of a clock signal based on the pulse width of the second reference signal MCLK. The modulation circuit according to the embodiment of the present disclosure modulates the pulse width of the clock signal when the pulse width of the second reference signal MCLK is equal to or more than a predetermined reference pulse width.

The reference pulse width may be set differently depending on embodiments. The pulse widths of the respective second reference signals MCLK may be adjusted by the reference signal generation circuit 13.

For example, as illustrated in FIG. 7, when the pulse widths of the second reference signals 75 to 77 which are generated by the reference signal generation circuit 13 and inputted to the level shifter 15 are less than the predetermined reference pulse width, the modulation circuit included in the level shifter 15 does not modulate the pulse widths of the clock signals CLK1 to CLK3 which are generated based on the respective second reference signals 75 to 77.

However, when the pulse width of the second reference signal 78 inputted to the level shifter 15 is equal to or more than the predetermined reference pulse width, the modulation circuit modulates the pulse width of the clock signal CLK4 generated based on the second reference signal 78.

Specifically, the modulation circuit performs a modulation operation of lowering the voltage level of the fourth clock signal CLK4 from a gate high voltage VGH to a predetermined gate middle voltage VGM at a time point corresponding to a rising edge of the second reference signal 78, and lowering the voltage level of the fourth clock signal CLK4 to a gate low voltage VGL at a time point corresponding to the falling edge of the second reference signal 78.

For reference, in the present embodiment, the reference signal generation circuit 13 may adjust the pulse width of the fourth second reference signal 78 to the reference pulse width or more and output the adjusted signal. However, the order of the second reference signal MCLK of which the pulse width is adjusted by the reference signal generation circuit 13 may differ depending on embodiments.

FIG. 8 illustrates the waveforms of gate signals which are generated based on the first to fourth clock signals CLK1 to CLK4 generated by the level shifter 15 according to the embodiment of FIG. 7 and the magnitude changes of the gate-source voltages Vgs of the driving transistors Td of the sub pixels SP included in the respective sub pixel rows . . . , R(n+1), R(n+2), R(n+3), R(n+4), R(n+5), . . . according to the overlap operation and the fake data insertion operation which are performed based on the corresponding gate signals.

Referring to FIGS. 7 and 8, the magnitudes of the gate signals which are generated based on the clock signals which are not modulated by the modulation circuit of the level shifter 15, that is, the first to third clock signals CLK1 to CLK3 are constantly maintained during the turn-on level period. For example, the magnitudes of the gate signals applied to the sub pixel rows R(n+1), R(n+2) and R(n+3) which are generated based on the first to third clock signals CLK1 to CLK3 are retained as the same magnitude. Also, the magnitudes of the gate signals applied to the sub pixel rows R(n+5), R(n+6) and R(n+7) are retained as the same magnitude.

However, the magnitude of the gate signal which is generated based on the fourth clock signal CLK4 modulated by the modulation circuit of the level shifter 15 is not constantly retained during the turn-on level period. For example, as illustrated in FIG. 8, the gate signal magnitude of the non-overlap period H4 of the gate signal which is generated based on the fourth clock signal CLK4 and applied to the sub pixel row R(n+4) becomes smaller than the gate signal magnitude of the overlap period H3. That is because, as described above, the voltage level of the fourth clock signal CLK4 decreases as a part of the fourth clock signal CLK4 used for generating the gate signal applied to the sub pixel row R(n+4) is modulated. The same reason is also applied to the sub pixel row R(n+8).

In the embodiment of the present disclosure, the magnitude of the non-overlap period (for example, H4) of the gate signal just before the time point FDIP at which the fake data insertion operation is performed, for example, the gate signal applied to the sub pixel row R(n+4) is retained as a smaller magnitude than that of the overlap period H3.

Through the adjusting of the magnitude of the gate signal, the gate node voltage Vg of the driving transistor Td is lowered in the non-overlap period (for example, H4) of the gate signal just before the time point FDIP at which the fake data insertion operation is performed, for example, the gate signal applied to the sub pixel row R(n+4).

When the gate node voltage Vg of the driving transistor Td is lowered in the non-overlap period (for example, H4) of the gate signal just before the time point FDIP at which the fake data insertion operation is performed, for example, the gate signal applied to the sub pixel row R(n+4), the magnitude of the gate-source voltage Vgs of the corresponding period is also reduced in comparison to the related art.

For example, when the gate signal magnitude of the non-overlap period H4 of the gate signal applied to the sub pixel row R(n+4) is lowered as illustrated in FIG. 8, the magnitude of the gate-source voltage Vgs4 of the driving transistor Td of the sub pixel SP disposed in the sub pixel row R(n+4) may be adjusted to the same or similar magnitude as or to the magnitude of the gate-source voltage Vgs1 of the driving transistor Td of the sub pixel SP disposed in the sub pixel row R(n+1).

By lowering the gate signal magnitude of the non-overlap period H4 of the gate signal applied to the sub pixel row R(n+4), it is possible to prevent a situation in which a specific line, for example, a line corresponding to the sub pixel row R(n+4) becomes excessively bright during the overlap operation in the related art.

Figure 9:
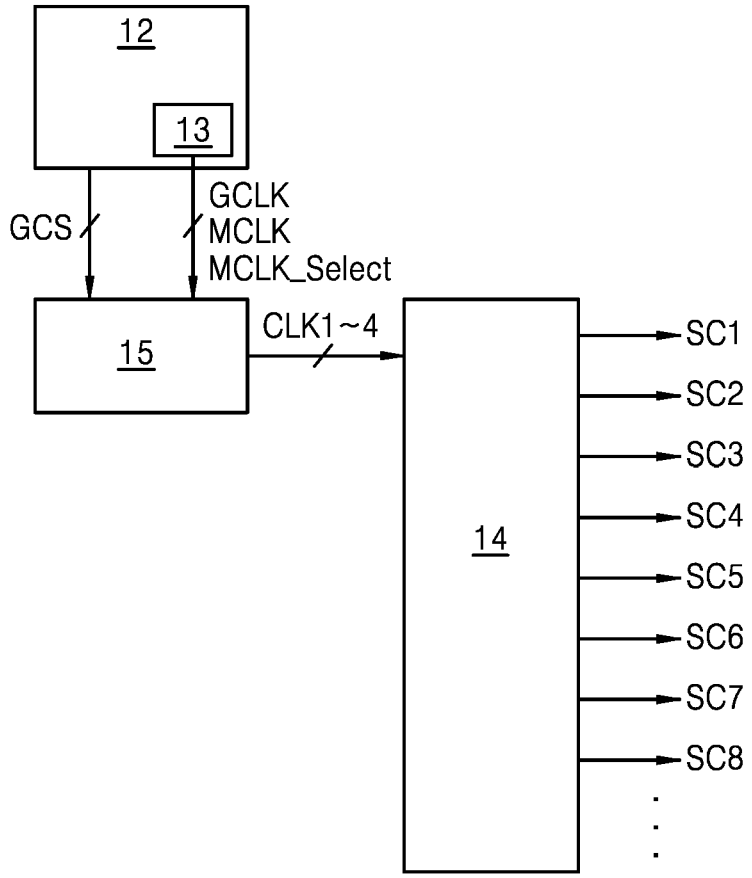
FIG. 9 illustrates a timing control circuit, a level shifter and a gate driving circuit which are included in a display device according to another embodiment of the present disclosure.
Figure 10:
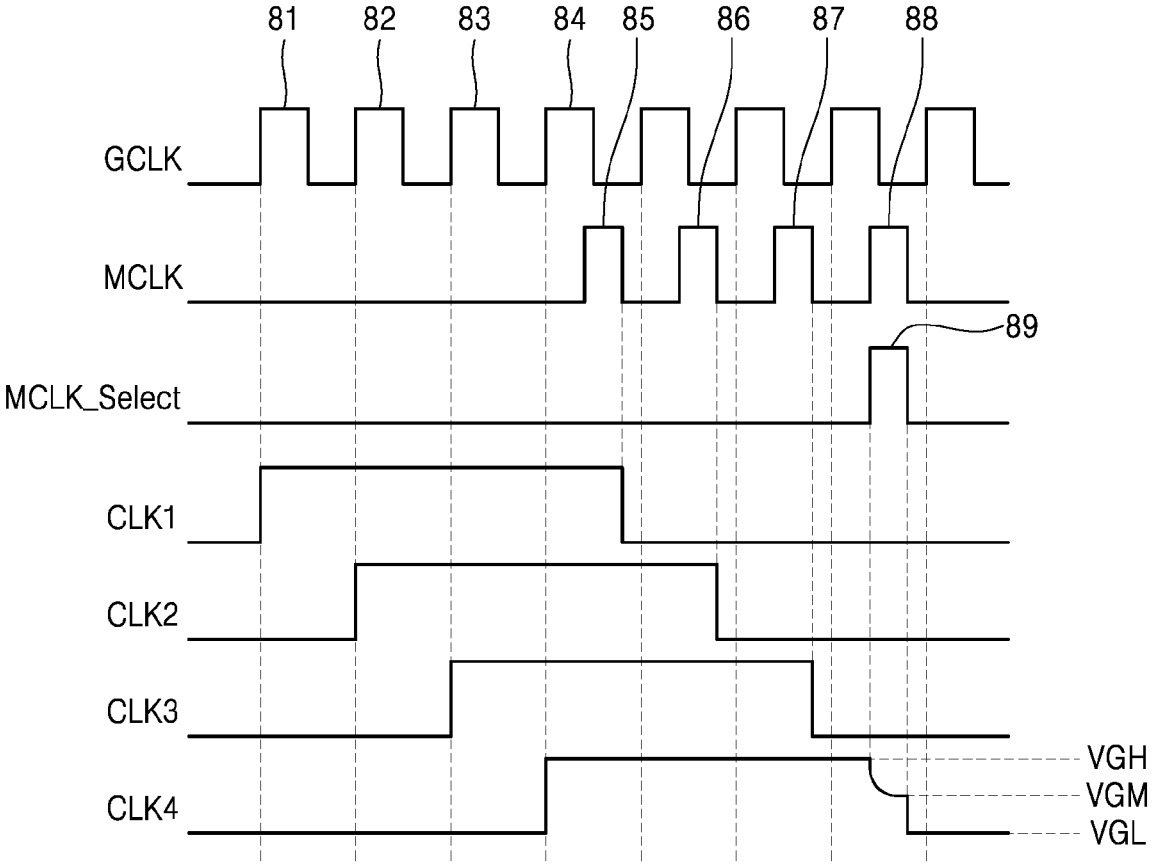
FIG. 10 illustrates the waveforms of clock signals generated by the level shifter of FIG. 9.

FIG. 9 illustrates a timing control circuit, a level shifter and a gate driving circuit which are included in a display device according to another embodiment of the present disclosure. FIG. 10 illustrates the waveforms of clock signals generated by the level shifter of FIG. 9.

Referring to FIG. 9, the display device according to the embodiment of the present disclosure includes a timing control circuit 12, a level shifter 15 and a gate driving circuit 14. The timing control circuit 12 includes a reference signal generation circuit 13.

The timing control circuit 12 supplies a gate control signal GCS and reference signals GCLK, MCLK and MCLK_Select to the level shifter 15. The gate control signal GCS may be transferred to the gate driving circuit 14 through the level shifter 15, or directly transferred to the gate driving circuit 14 from the timing control circuit 12 without passing through the level shifter 15.

In the present embodiment, the reference signals GCLK, MCLK and MCLK_Select include a first reference signal GCLK, a second reference signal MCLK and a clock select signal MCLK_Select. The first reference signal GCLK, the second reference signal MCLK and the clock select signal MCLK_Select are generated by the reference signal generation circuit 13, and supplied to the level shifter 15.

The level shifter 15 generates a plurality of clock signals based on the first reference signal GCLK, the second reference signal MCLK and the clock select signal MCLK_Select which are generated and supplied by the reference signal generation circuit 13. For example, as illustrated in FIG. 10, the level shifter 15 may generate four clock signals, i.e., a first clock signal CLK1, a second clock signal CLK2, a third clock signal CLK3 and a fourth clock signal CLK4, based on the first reference signal GCLK, the second reference signal MCLK and the clock select signal MCLK_Select. In an embodiment, however, the level shifter 15 may generate less than four clock signals or five or more clock signals.

The gate driving circuit 14 generates gate signals SC1, SC2, SC3, SC4, . . . based on the first to fourth clock signals CLK1 to CLK4 which are generated and supplied by the level shifter 15. For example, the gate driving circuit 14 according to the present embodiment generates first to fourth gate signals SC1 to SC4 based on the first to fourth clock signals CLK1 to CLK4, respectively, and generates fifth to eighth gate signals SC5 to SC8 based on the first to fourth clock signals CLK1 to CLK4, respectively. However, the number of clock signals inputted to the gate driving circuit 14 and the types and number of gate signals generated in response to the respective clock signals may be changed depending on embodiments.

Referring to FIG. 10, the level shifter 15 according to the embodiment of the present disclosure generates four clock signals, i.e., the first to fourth clock signals CLK1 to CLK4, based on the first reference signal GCLK and the second reference signal MCLK which are sequentially inputted with a predetermined time interval and the clock select signal MCLK_Select inputted at specific timing.

For example, the level shifter 15 generates the first clock signal CLK1 having a rising edge corresponding to a rising edge of a first reference signal 81. Furthermore, a falling edge of the first clock signal CLK1 generated by the level shifter 15 corresponds to a falling edge of a first second reference signal 85.

In a similar way, the level shifter 15 generates the second clock signal CLK2 having a rising edge corresponding to a rising edge of a second first reference signal 82 and a falling edge corresponding to a falling edge of a second reference signal 86, the third clock signal CLK3 having a rising edge corresponding to a rising edge of a third first reference signal 83 and a falling edge corresponding to a falling edge of a third second reference signal 87, and the fourth clock signal CLK4 having a rising edge corresponding to a rising edge of a fourth first reference signal 84 and a falling edge corresponding to a falling edge of a fourth second reference signal 88.

Through such a process, the level shifter 15 generates the first to fourth clock signals CLK1 to CLK4 which are sequentially delayed by the cycle of the first reference signal GCLK.

The level shifter 15 according to the embodiment of FIGS. 9 and 10 may include a modulation circuit for modulating the pulse width of a clock signal based on whether the clock select signal MCLK_Select is inputted. The modulation circuit according to the embodiment of the present disclosure modulates the pulse width of the clock signal when the clock select signal MCLK_Select is inputted.

For example, when the clock select signal MCLK_Select is not inputted as illustrated in FIG. 10, the modulation circuit included in the level shifter 15 does not modulate the pulse widths of the clock signals CLK1 to CLK3 which are generated based on the second reference signals 85 to 87, respectively.

However, when the clock select signal MCLK_Select is inputted with the first and second reference signals GCLK and MCLK, the modulation circuit modulates the pulse width of the fourth clock signal CLK4 which is generated based on the second reference signal MCLK or the clock select signal MCLK_Select.

The modulation circuit performs a modulation operation of lowering the voltage level of the fourth clock signal CLK4 from a gate high voltage VGH to a predetermined gate middle voltage VGM at a time point corresponding to the rising edge of the clock select signal MCLK_Select or the second reference signal 88, and lowering the voltage level of the fourth clock signal CLK4 to a gate low voltage VGL at a time point corresponding to a falling edge of the clock select signal MCLK_Select or the second reference signal 88.

For reference, in the present embodiment, the reference signal generation circuit 13 outputs the clock select signal MCLK_Select to correspond to the output timing of the fourth second reference signal 88, but the timing at which the clock select signal MCLK_Select is outputted by the reference signal generation circuit 13 may be changed depending on embodiments.

The first to fourth clock signals CLK1 to CLK4 which are generated according to the embodiment of FIGS. 9 and 10 are the same as the first to fourth clock signals CLK1 to CLK4 which are generated according to the embodiment of FIGS. 6 and 7. Therefore, the gate signals generated based on the first to fourth clock signals CLK1 to CLK4 which are generated according to the embodiment of FIGS. 9 and 10 and an overlap operation and a fake data insertion operation of the display device, which are performed according to the gate signals, may have the same processes and results as those of FIG. 8. Thus, it is also possible to prevent a situation in which a specific line becomes excessively bright.

As described above, the display device according to the embodiment of the present disclosure performs the fake data insertion operation FDIP of supplying fake data through the data line before the gate signal for the (n+1)th gate line (for example, the gate line corresponding to R(n+5) of FIG. 8) is supplied after the gate signal for the n-th gate line (for example, the gate line corresponding to R(n+4) of FIG. 8) is supplied.

As defined above, the turn-on level period of the gate signal for the n-th gate line (for example, the gate line corresponding to R(n+4) of FIG. 8) includes an overlap period (for example, H3) that overlaps the turn-on level period (for example, H2) of the gate signal for the (n−1)th gate line (for example, the gate line corresponding to R(n+3) of FIG. 8) and a non-overlap period (for example, H4) that does not overlap the turn-on level period of the gate signal for the (n−1)th gate line.

The gate driving circuit according to the embodiment of the present disclosure retains the magnitude of the non-overlap period (for example, H4) of the gate signal for the n-th gate line (for example, the gate line corresponding to R(n+4) of FIG. 8) as a smaller magnitude than that of the overlap period (for example, H3) of the gate signal for the n-th gate line.

Such an operation of the gate driving circuit can prevent a situation in which a specific line becomes excessively bright during the overlap operation.

According to the embodiment of the present disclosure, the display device can raise the quality of an image by improving the voltage charge ratios of sub pixels, when displaying the image.

Furthermore, the display device can reduce motion blur indicating a phenomenon that the boundaries of moving objects are not clearly displayed but seem to be spread or the objects seem to be drawn, when a video is displayed.

Furthermore, the display device can prevent a situation in which a specific line becomes excessively bright when an image is displayed.

While various embodiments have been described above, it will be understood to those skilled in the art that the embodiments described are by way of example. Accordingly, the disclosure described herein should not be limited based on the described embodiments.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel including a plurality of data lines, a plurality of gate lines, and a plurality of sub pixels;

a data driving circuit configured to supply image data and fake data to the plurality of data lines;

a gate driving circuit configured to supply gate signals to the plurality of gate lines;

a level shifter configured to supply the gate driving circuit with a plurality of clock signals for generating the gate signals; and a reference signal generation circuit configured to supply the level shifter with a first reference signal and a second reference signal for generating the plurality of clock signals, wherein a turn-on level period of a gate signal for an n-th gate line includes an overlap period that overlaps a turn-on level period of a gate signal for an (n−1)th gate line, and a non-overlap period that does not overlap the turn-on level period of the gate signal for the (n−1)th gate line, and wherein the level shifter modulates a pulse width of a clock signal corresponding to the non-overlap period of the gate signal for the n-th gate line among the plurality of clock signals and does not modulate a pulse width of a clock signal corresponding to the overlap period of the gate signal for the n-th gate line to cause a gate node voltage of a driving transistor for the n-th gate line in the non-overlap period to be smaller than a gate node voltage of a driving transistor for the n-th gate line in the overlap period.

2. The display device of claim 1, wherein the reference signal generation circuit adjusts a pulse width of the second reference signal to less than a predetermined reference pulse width, or equal to or greater than the predetermined reference pulse width, and the level shifter modulates the pulse width of the clock signal when the pulse width of the second reference signal is equal to or greater than the predetermined reference pulse width.

3. The display device of claim 1, wherein the reference signal generation circuit supplies a clock select signal to the level shifter, and the level shifter modulates the pulse width of the clock signal in response to the clock select signal being supplied to the level shifter.

4. A display device, comprising:

an organic light emitting diode (OLED) display panel including a plurality of data lines, a plurality of gate lines, and a plurality of sub pixels;

a data driving circuit configured to supply image data and fake data to the plurality of data lines;

a level shifter configured to supply a plurality of clock signals; and a gate driving circuit configured to supply gate signals to the plurality of gate lines based on the plurality of clock signals, wherein the data driving circuit supplies the fake data to the plurality of data lines before a gate signal for an (n+1)th gate line is supplied and after a gate signal for an n-th gate line is supplied, wherein a turn-on level period of the gate signal for the n-th gate line includes an overlap period that overlaps a turn-on level period of a gate signal for an (n−1)th gate line, and a non-overlap period that does not overlap the turn-on level period of the gate signal for the (n−1)th gate line, wherein the level shifter modulates a pulse width of a clock signal corresponding to the non-overlap period of the gate signal for the n-th gate line among the plurality of clock signals and does not modulate a pulse width of a clock signal corresponding to the overlap period of the gate signal for the n-th gate line, to cause a gate node voltage of a driving transistor for the n-th gate line in the non-overlap period to be smaller than a gate node voltage of a driving transistor for the n-th gate line in the overlap period.

5. The display device of claim 4, wherein a precharge operation for sub pixels arranged in a sub pixel row corresponding to the (n+1)th gate line is performed in a non-overlap period of the gate signal for the (n+1)th gate line.

6. The display device of claim 4, wherein the gate driving circuit retains a magnitude of the gate signal for the n-th gate line in the non-overlap period to be smaller than a magnitude of the gate signal for the n-th gate line in the overlap period.

7. The display device of claim 6, wherein a magnitude of a gate-source voltage of a driving transistor of a sub pixel in a sub pixel row corresponding to the n-th gate line in the non-overlap period is the same as or similar to that in the overlap period.

8. The display device of claim 4, wherein the fake data insertion operation is performed based on one sub pixel row or a plurality of sub pixel rows, and wherein the fake data is concurrently supplied to sub pixels rows of the plurality of sub pixel rows that have already passed an emission period.

9. The display device of claim 4, further comprising:

a reference signal generation circuit configured to supply the level shifter with a first reference signal and a second reference signal for generating the plurality of clock signals, or supply the level shifter with the first reference signal, the second reference signal, and a clock select signal for generating the plurality of clock signals.

10. The display device of claim 9, wherein the level shifter modulates the pulse width of a clock signal of the plurality of clock signals when the pulse width of the second reference signal is equal to or greater than a predetermined reference pulse width, or when the clock select signal is supplied to the level shifter.

11. A method for driving a display device including a display panel having a plurality of data lines, a plurality of gate lines, and a plurality of sub pixels, the method comprising:

supplying image data and fake data to the plurality of data lines;

supplying a level shifter with a first reference signal and a second reference signal for generating a plurality of clock signals; and supplying a gate driving circuit with the plurality of clock signals for generating gate signals supplied to the plurality of gate lines;

wherein a turn-on level period of a gate signal for an n-th gate line includes an overlap period that overlaps a turn-on level period of a gate signal for an (n−1)th gate line, and a non-overlap period that does not overlap the turn-on level period of the gate signal for the (n−1)th gate line, and wherein the level shifter modulates a pulse width of a clock signal corresponding to the non-overlap period of the gate signal for the n-th gate line among the plurality of clock signals and does not modulate a pulse width of a clock signal corresponding to the overlap period of the gate signal for the n-th gate line, to cause a gate node voltage of a driving transistor for the n-th gate line in the non-overlap period to be smaller than a gate node voltage of a driving transistor for the n-th gate line in the overlap period.

12. The method of claim 11, wherein the level shifter modulates a pulse width of a clock signal of the plurality of clock signals when a pulse width of the second reference signal is equal to or greater than a predetermined reference pulse width.

13. The method of claim 11, further comprising:

supplying a clock select signal to the level shifter, wherein the level shifter modulates a pulse width of a clock signal of the plurality of clock signals in response to the clock select signal being supplied to the level shifter.

14. The method of claim 11, wherein the fake data is supplied to the plurality of data lines before a gate signal for an (n+1)th gate line is supplied and after the gate signal for an n-th gate line is supplied.

15. The method of claim 11, wherein a magnitude of a gate-source voltage of a driving transistor of a sub pixel in a sub pixel row corresponding to the n-th gate line in the non-overlap period is the same as or similar to that in the overlap period.

* * * * *